US006894470B2

(12) United States Patent
Umemoto et al.

(10) Patent No.: US 6,894,470 B2
(45) Date of Patent: May 17, 2005

(54) POWER SUPPLY DEVICE AND ELECTRIC APPLIANCE EMPLOYING THE SAME

(75) Inventors: Kiyotaka Umemoto, Kyoto (JP); Ko Takemura, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 45 days.

(21) Appl. No.: 10/298,980

(22) Filed: Nov. 19, 2002

(65) Prior Publication Data

US 2003/0098680 A1 May 29, 2003

(30) Foreign Application Priority Data

Nov. 27, 2001 (JP) ..... 2001-361205

(51) Int. Cl.[7] ..... G05F 1/575
(52) U.S. Cl. ..... 323/281
(58) Field of Search ..... 323/274, 275, 323/280, 281, 297, 298, 314, 353, 354

(56) References Cited

U.S. PATENT DOCUMENTS 4,489,270 A * 12/1984 Diller ..... 323/354
5,231,316 A * 7/1993 Thelen, Jr. ..... 327/103
6,366,154 B2 * 4/2002 Pulvirenti ..... 327/525

FOREIGN PATENT DOCUMENTS

JP 2000-047738 A1 2/2002

* cited by examiner

*Primary Examiner*—Gary L. Laxton
(74) *Attorney, Agent, or Firm*—Morgan, Lewis & Bockius LLP

(57) ABSTRACT

A power supply device has a reference voltage generator for generating a reference voltage, a monitor voltage generator for generating a monitor voltage that varies according to an output voltage, an output controller for producing the output voltage from an input voltage in such a way that the monitor voltage is kept equal to the reference voltage and then supplying the output voltage to a load, and a reference voltage adjuster for varying the reference voltage according to the monitor voltage. This makes it possible to reduce, with a simple configuration, variation in the output voltage resulting from variation in the power source or the load.

7 Claims, 2 Drawing Sheets

POWER SUPPLY DEVICE AND ELECTRIC APPLIANCE EMPLOYING THE SAME

BACKGROUND OF THE INVENTION

1. Field of the Invention

The present invention relates to a power supply device that produces from an input voltage a predetermined output voltage to be supplied to a load in such a way that a monitor voltage that varies according to the output voltage is kept equal to a reference voltage. The present invention relates also to an electric appliance employing such a power supply device.

2. Description of the Prior Art

In a power supply device that produces from an input voltage a predetermined output voltage to be supplied to a load in such a way that a monitor voltage that varies according to the output voltage is kept equal to a reference voltage, feedback control is performed so that, even when the input voltage or the current flowing through the load (hereinafter referred to as the load current) varies to a certain degree, the output voltage is kept at a predetermined level.

However, even though feedback control as described above is performed, the output voltage of a power supply device generally tends to increase as the input voltage increases and decrease as the load current increases. Thus, a power supply device configured as described above has the disadvantage of being unable to keep the output voltage at a predetermined level when the input voltage or the load current varies greatly.

To overcome this, in a conventional power supply device, variation in the output voltage resulting from variation in the power source or the load is reduced by adjusting, according to the load current, the gain of a regulator IC used as an output control means (refer to, for example, Japanese Patent Application Laid-Open No. 2000-47738).

It is true that, in a power supply device configured as described just above, variation in the output voltage resulting from variation in the power source or the load can be reduced so that the output voltage is kept within a predetermined range (within the rated range of voltages in which the load is supposed to operate).

However, in an attempt to solve the above problem through the adjustment of the gain of a regulator IC, it is extremely difficult to strike a proper balance between the reduction of variation in the output voltage resulting from variation in the power source or the load (i.e., the increasing of the gain of the regulator IC) and the likeliness of oscillation, because there is a tradeoff between these two factors.

In particular, lately, as increasingly strict requirements are imposed on the specifications of the power to be supplied to a load, increasingly precise power supply devices are sought that are less prone to variation in the output voltage even in the face of great variation in the input or the load. To realize such a power supply device, it is necessary to vary the gain widely according to the input voltage or the load current so as to minimize variation in the output voltage, and simultaneously secure a sufficient phase margin to avoid oscillation over the entire range of the gain. This makes the designing of a power supply device extremely difficult.

SUMMARY OF THE INVENTION

An object of the present invention is to provide a power supply device that, despite having a simple configuration, operates with reduced variation in the output voltage resulting from variation in the power source or the load. Another object of the present invention is to provide an electric appliance employing such a power supply device.

To achieve the above object, according to the present invention, a power supply device is provided with: a reference voltage generator for generating a reference voltage; a monitor voltage generator for generating a monitor voltage that varies according to an output voltage; an output controller for producing the output voltage from an input voltage in such a way that the monitor voltage is kept equal to the reference voltage and then supplying the output voltage to a load; and a reference voltage adjuster for varying the reference voltage according to the monitor voltage.

BRIEF DESCRIPTION OF THE DRAWINGS

This and other objects and features of the present invention will become clear from the following description, taken in conjunction with the preferred embodiments with reference to the accompanying drawings in which.

DESCRIPTION OF THE PREFERRED EMBODIMENTS

Figure 1:
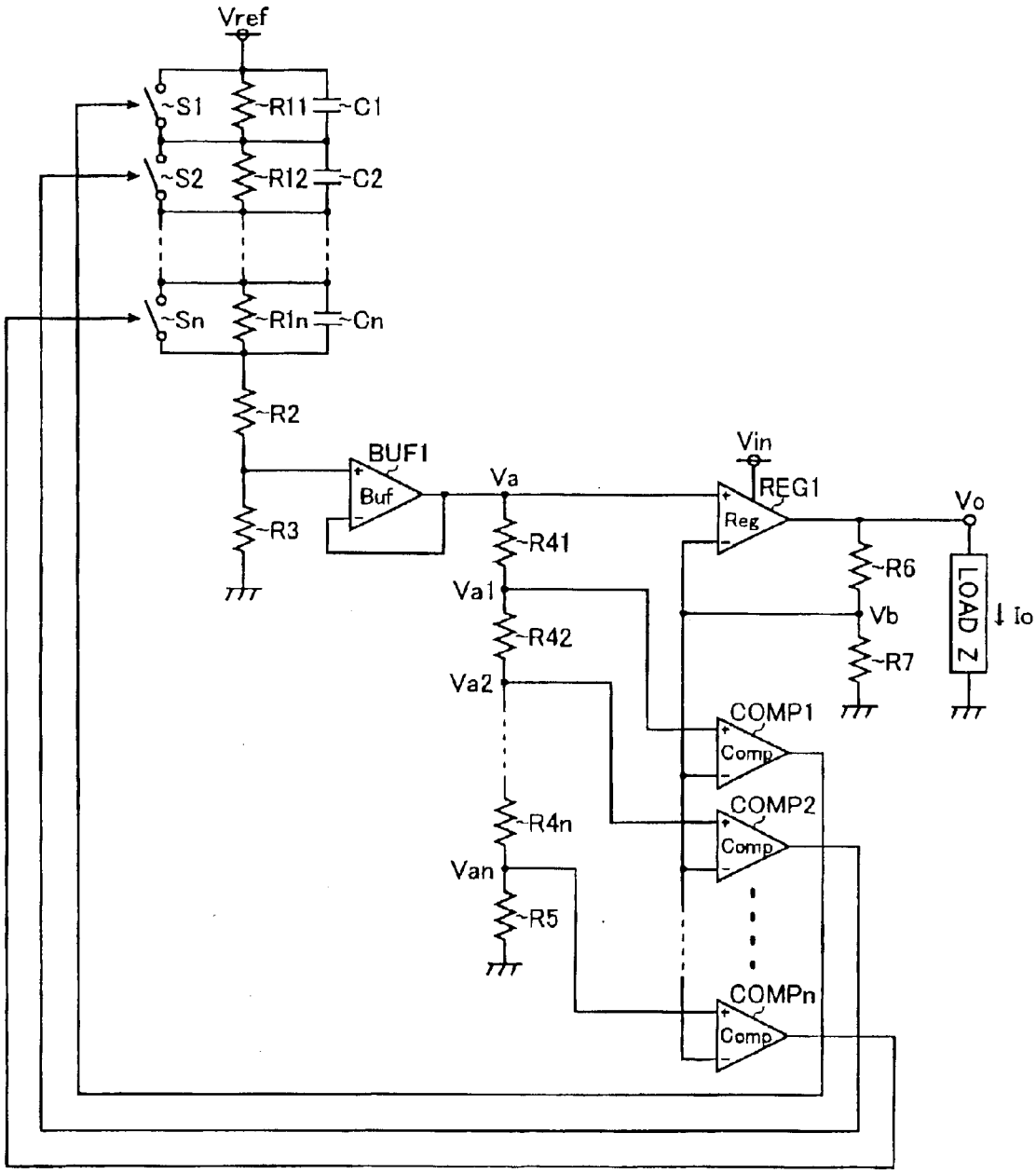
FIG. 1 is a circuit diagram of an example of a power supply device embodying the invention.

FIG. 1 is a circuit diagram of an example of a power supply device embodying the invention. In this figure, a regulator output circuit REG1 functions as an output controlling means. Specifically, the regulator output circuit REG1 produces an output voltage Vo from an input voltage Vin, and supplies the produced output voltage to a load Z. In so doing, the regulator output circuit REG1 compares a reference voltage Va obtained by dividing a constant voltage Vref with a monitor voltage Vb obtained by dividing the output voltage Vo, and controls the output voltage Vo in such a way as to increase it when Va>Vb and decrease it when Va<Vb.

That is, in the regulator output circuit REG1, feedback control is performed so that, even when the input voltage Vin or the current Io flowing through the load Z (hereinafter referred to as the load current Io) varies, the output voltage Vo is kept at a predetermined level. Applicable as the regulator output circuit REG1 here are the output circuits of various types of series regulator IC, switching regulator IC, and the like.

A reference voltage generator divides the constant voltage Vref to generate the reference voltage Va. The reference voltage generator includes n resistors R11 to R1*n* and another two resistors R2 and R3, all connected in series between a power source line to which the constant voltage Vref is applied and ground, n switches S1 to Sn each connected in parallel with one of the resistors R11 to R1*n*, and n capacitors C1 to Cn each connected in parallel with one of the resistors R11 to R1*n*. The node between the resistors R2 and R3 serves as the output end of the reference voltage generator, and is connected through a buffer BUF1 to the non-inverting input terminal of the regulator output circuit REG1. Thus, as the switches S1 to Sn are individually turned on and off, the reference voltage generator permits the division factor by which the constant voltage Vref is divided to be varied in n steps, and thereby permits the reference voltage Va to be varied stepwise.

Here, the switches S1 to Sn are turned on and off respectively by n comparators COMP1 to COMPn that each compare one of the voltage levels Va1 to Van obtained by dividing the reference voltage Va with the monitor voltage Vb. Specifically, the switches S1 to Sn are in an on state when the corresponding comparators COMP1 to COMPn are outputting a H (logical high) level, and are in an off state when the corresponding comparators COMP1 to COMPn are outputting a L (logical low) level.

Moreover, as described above, in the reference voltage generator of this embodiment, in parallel with the resistors R11 to R1*n* are connected not only the switches S1 to Sn but also the capacitors C1 to Cn. This reduces the switching noise that is superimposed on the reference voltage Va when the switches S1 to Sn are switched.

A voltage level generator divides the reference voltage Va to generate the n different voltage levels Va1 to Van. The voltage level generator is composed of n resistors R41 to R4*n* and another resistor R5, all connected in series between the output terminal of the buffer BUF1 and ground. The nodes between every two resistors serve as output ends of the voltage level generator, and are connected respectively to the non-inverting input terminals of the comparators COMP1 to COMPn.

A monitor voltage generator divides the output voltage Vo to generate the monitor voltage Vb. The monitor voltage generator is composed of resistors R6 and R7 connected in series between the output terminal of the regulator output circuit REG1 and ground. The node between the resistors R6 and R7 serves as the output end of the monitor voltage generator, and is connected to the inverting input terminals of the regulator output circuit REG1 and of all the comparators COMP1 to COMPn.

Thus, the comparators COMP1 to COMPn output a H level when the monitor voltage Vb is lower than the corresponding voltage levels Va1 to Van, and otherwise output a L level.

Figure 2:
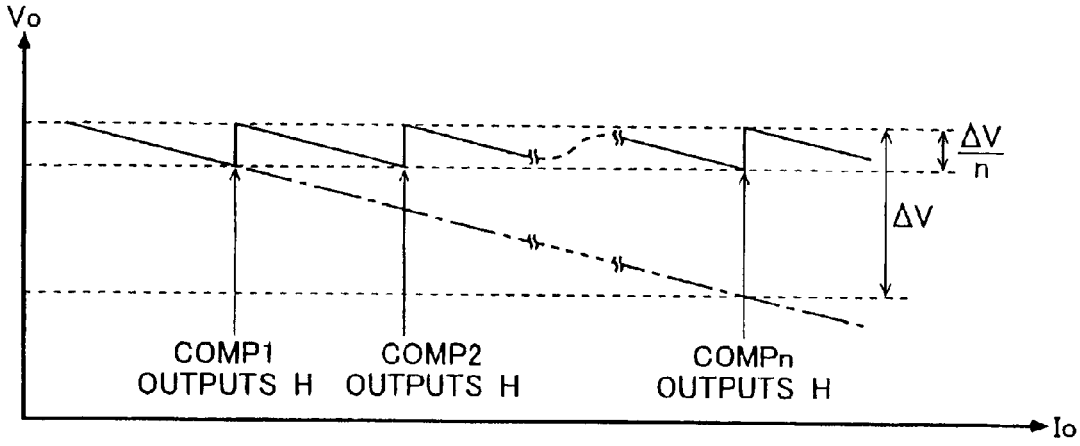
FIG. 2 is a diagram showing the relationship between the load current Io and the output voltage Vo.

Next, the operation of the power supply device configured as described above will be described in detail with reference to FIG. 2. FIG. 2 shows the relationship between the load current lo and the output voltage Vo. In the figure, the solid line represents the relationship between the load current Io and the output voltage Vo as observed in the power supply device of this embodiment, and the dash-and-dot line represents, for comparison, the relationship between the load current Io and the output voltage Vo as observed when the reference voltage Va is kept constant. Here, it is assumed that, at the left-hand end of the diagram, all the switches S1 to Sn are off so that the reference voltage Va is set at its minimum level.

From the state described above, as the load current Io increases, the output voltage Vo decreases accordingly, and thus the monitor voltage Vb decreases accordingly. When the monitor voltage Vb becomes lower than the voltage level Va1, the output of the comparator COMP1 turns from a L level to a H level, turning on the switch S1. Thus, the reference voltage Va is raised to the level one step higher than its current level. As a result, the regulator output circuit REG1 raises the output voltage Vo until the monitor voltage Vb becomes equal to the reference voltage Va thus raised to the one step higher level.

In this embodiment, the voltage level generator is so configured as to generate the voltage levels Va1 to Van by dividing the reference voltage Va. Thus, when the reference voltage Va is raised, the voltage levels Va1 to Van are also raised. Therefore, by appropriately setting the division factors in the reference voltage generator and the voltage level generator, it is possible to prevent the output of the comparator COMP1 from returning to a L level as the result of the output voltage Vo being raised as described above.

As the load current Io increases further, similar operation is repeated. Specifically, as the output voltage Vo decreases, every time the monitor voltage Vb becomes lower than one of the voltage levels Va2 to Van, the output of the corresponding one of the comparators COMP2 to COMPn turns from a L level to a H level, and the reference voltage Va is raised to the level one step higher. Thus, the regulator output circuit REG1 raises the output voltage Vo until the monitor voltage Vb becomes equal to the reference voltage Va in each step.

In this way, by varying the reference voltage Va according to the monitor voltage Vb, it is possible to reduce variation in the output voltage Vo resulting from variation in the load to 1/n of the variation $\Delta V$ that occurs when the reference voltage Va is kept constant. Moreover, even when an alteration is made in the requirements for the power to be supplied to the load Z, it is possible to cope with it quickly simply by changing the number n of bits controlled. Furthermore, in the power supply device of this embodiment, the gain of the regulator output circuit REG1 can be kept constant, and therefore the phase margin has only to be set to avoid oscillation at a given gain. This makes the designing of a power supply device very easy.

The embodiment described above deals with an example in which variation in the output voltage resulting from variation in the load is reduced. Needless to say, variation in the output voltage resulting from variation in the power source can be reduced by similar operation. The above descriptions deal only with a power supply device, but the circuit according to the present invention can be used also as a power supply circuit provided within ICs to form a variety of devices. It is possible to use as the regulator output circuit REG1 the configuration of the output circuit described as a conventional example.

As described above, according to the present invention, a power supply device that produces from an input voltage an output voltage to be supplied to a load in such a way that a monitor voltage that varies according to the output voltage is kept equal to a reference voltage is provided with a reference voltage adjusting means for varying the reference voltage according to the monitor voltage. With this configuration, it is possible to reduce variation in the output voltage resulting from variation in the power source or the load without varying the gain of the regulator used as an output control means of the power supply device. As a result, the regulator has only to be given such a phase margin as to avoid oscillation at a given gain. This makes the designing of a power supply device easy.

In the power supply device configured as described above, it is advisable that the reference voltage adjusting means be composed of a voltage level generator for generating n different voltage levels by dividing the reference voltage, n comparators each comparing one of those voltage levels with the monitor voltage, and a reference voltage generator for generating the reference voltage according to the outputs of the individual comparators. With this configuration, it is possible to reduce variation in the output voltage resulting from variation in the power source or the load to 1/n of the variation that occurs when the reference voltage is kept constant. Moreover, even when an alteration is made in the requirements for the power to be supplied to the load, it is possible to cope with it quickly simply by changing the number n of bits controlled.

Moreover, in the power supply device configured as described above, it is advisable that the reference voltage generator be composed of n resistors connected in series to a power source line to which a constant voltage is applied, n switches each connected in parallel with one of the resistors, and n capacitors each connected in parallel with one of the resistors, and be so configured as to vary the division factor by which the constant voltage is divided in n steps as the switches are individually turned on and off according to the outputs of the aforementioned comparators. With this configuration, it is possible to reduce the switching noise that is superimposed on the reference voltage when it is switched from one level to another.

What is claimed is:

1. A power supply device comprising:

a reference voltage generator for generating a reference voltage;

a monitor voltage generator for generating at any time a monitor voltage that varies according to load fluctuation;

an output controller for producing an output voltage from an input voltage so that the monitor voltage is kept equal to the reference voltage and then supplying the output voltage to a load; and a reference voltage adjuster for varying the reference voltage according to the monitor voltage.

2. A power supply device as claimed in claim 1, wherein the reference voltage generator generates the reference voltage by dividing a predetermined constant voltage by a division factor according to an instruction from the reference voltage adjuster.

3. A power supply device as claimed in claim 2, wherein the reference voltage generator comprises:

n resistors connected in series in a power source line to which the constant voltage is applied; and n switches each connected in parallel with one of the resistors, the switches being individually turned on and off so that the division factor by which the constant voltage is divided is varied in n steps.

4. A power supply device as claimed in claim 3, wherein the reference voltage generator further comprises:

n capacitors each connected in parallel with one of the resistors.

5. A power supply device as claimed in claim 3, wherein the reference voltage adjuster comprises:

a voltage level generator for generating n different voltage levels by dividing the reference voltage; and n comparators each comparing one of the voltage levels with the monitor voltage, the switches being individually turned on and off according to outputs from the individual comparators.

6. A power supply device as claimed in claim 1, wherein a gain of the output controller is adjusted according to a load current.

7. An electric appliance including a power supply device, wherein the power supply device comprises:

a reference voltage generator for generating a reference voltage;

a monitor voltage generator for generating at any time a monitor voltage that varies according to load fluctuation;

an output controller for producing an output voltage from an input voltage so that the monitor voltage is kept equal to the reference voltage and then supplying the output voltage to a load; and a reference voltage adjuster for varying the reference voltage according to the monitor voltage.

* * * * *